US006869917B2

(12) United States Patent
Deckman et al.

(10) Patent No.: US 6,869,917 B2
(45) **Date of Patent: *Mar. 22, 2005**

(54) FUNCTIONAL FLUID LUBRICANT USING LOW NOACK VOLATILITY BASE STOCK FLUIDS

(75) Inventors: Douglas E. Deckman, Mullica Hill, NJ (US); Mark D. Winemiller, Clarksboro, NJ (US); William L. Maxwell, Pilesgrove, NJ (US); David J. Baillargeon, Cherry Hill, NJ (US); Norman Yang, Westfield, NJ (US); Maria Caridad B. Goze, East Brunswick, NJ (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 147 days.

This patent is subject to a terminal disclaimer.

(21) Appl. No.: 10/222,057

(22) Filed: Aug. 16, 2002

(65) Prior Publication Data

US 2004/0033908 A1 Feb. 19, 2004

(51) Int. Cl.[7] ..... C10M 107/10; C10M 171/02

(52) U.S. Cl. ..... 508/110; 508/591; 585/1; 585/10; 585/250; 585/521; 585/525; 208/19; 208/142

(58) Field of Search ..... 508/110, 591; 585/1

(56) References Cited

U.S. PATENT DOCUMENTS

| | | | | |
|---|---|---|---|---|
| 1,815,022 | A | 7/1931 | Davis | 585/8 |
| 2,015,748 | A | 10/1935 | Frolich | 585/449 |
| 2,191,498 | A | 2/1940 | Reiff | 508/587 |
| 2,360,446 | A | 10/1944 | Reid | 196/151 |
| 2,387,501 | A | 10/1945 | Dietrich | 508/555 |
| 2,443,264 | A | 6/1948 | Mikeska | 508/424 |
| 2,471,115 | A | 5/1949 | Mikeska | 558/112 |
| 2,500,166 | A | 7/1950 | Seger et al. | 260/683.1 |
| 2,526,497 | A | 10/1950 | Mikeska | 508/424 |
| 2,591,577 | A | 4/1952 | McDermott | 508/424 |
| 2,655,479 | A | 10/1953 | Munday et al. | 508/466 |
| 2,666,746 | A | 1/1954 | Munday et al. | 508/467 |
| 2,719,125 | A | 9/1955 | Roberts | 508/273 |
| 2,719,126 | A | 9/1955 | Fields et al. | 508/273 |
| 2,721,877 | A | 10/1955 | Popkin et al. | 560/190 |
| 2,721,878 | A | 10/1955 | Popkin | 560/190 |
| 2,817,693 | A | 12/1957 | Koome et al. | 208/46 |
| 3,036,003 | A | 5/1962 | Verdol | 508/399 |
| 3,087,932 | A | 4/1963 | Little, Jr. | 548/142 |
| 3,087,936 | A | 4/1963 | Le Suer | 548/405 |
| 3,149,178 | A | 9/1964 | Hamilton et al. | 585/18 |
| 3,172,892 | A | 3/1965 | Le Suer et al. | 548/546 |
| 3,200,107 | A | 8/1965 | Le Suer | 564/24 |
| 3,215,707 | A | 11/1965 | Rense | 548/546 |
| 3,219,666 | A | 11/1965 | Norman et al. | 544/383 |
| 3,250,715 | A | 5/1966 | Wyman | 508/467 |
| 3,254,025 | A | 5/1966 | Le Suer | 508/192 |
| 3,272,746 | A | 9/1966 | Le Suer et al. | 508/554 |
| 3,275,554 | A | 9/1966 | Wagenaar | 508/558 |
| 3,316,177 | A | 4/1967 | Dorer, Jr. | 508/234 |
| 3,322,670 | A | 5/1967 | Burt et al. | 508/192 |
| 3,329,658 | A | 7/1967 | Fields | 525/327.6 |
| 3,341,542 | A | 9/1967 | Le Suer et al. | 544/243 |
| 3,382,291 | A | 5/1968 | Brennan | 585/521 |
| 3,413,347 | A | 11/1968 | Worrel | 564/367 |
| 3,438,757 | A | 4/1969 | Honnen et al. | 44/335 |
| 3,444,170 | A | 5/1969 | Norman et al. | 544/386 |
| 3,449,250 | A | 6/1969 | Fields | 508/291 |
| 3,454,555 | A | 7/1969 | van der Voort et al. | 548/962 |
| 3,454,607 | A | 7/1969 | Le Suer et al. | 554/150 |

(List continued on next page.)

FOREIGN PATENT DOCUMENTS

| | | |
|---|---|---|
| EP | 168 534 | 1/1986 |
| EP | 464 547 | 1/1992 |
| EP | 321 302 | 5/1992 |
| EP | 321 304 | 5/1993 |
| EP | 496 486 | 3/1994 |
| EP | 471 071 | 8/1995 |
| EP | 710 710 | 5/1996 |
| EP | 815 187 | 1/1998 |
| EP | 0933416 A1 | 8/1999 |
| GB | 1350257 | 4/1974 |
| GB | 1390359 | 4/1975 |
| GB | 1429494 | 3/1976 |
| GB | 1440230 | 6/1976 |
| GB | 2307243 A | 5/1997 |
| WO | 02/092729 A1 | 11/2002 |

OTHER PUBLICATIONS

Ronald L. Shubkin, "Alkylated Aromatics", Synthetic Lubricants and High–Performance Functional Fluids, Chapter 5, pp. 125–144, 1993.

Eapen et al., "Poly n–Alkylbenzene Compounds: A Class of Thermally Stable and Wide Liquid Range Fluids", ACS Petroleum Chemistry Preprint, pp. 1053–1058, 1984.

Brennan, James H., "Wide–Temperature Range Synthetic Hydrocarbon Fluids", *Chemistry of Synthetic Lubricants and Additives, H.V. Lawther 178th National Meeting of the American Chemical Society*, Washington, D.C., Sep. 1979.

James, B.D., et al, *Process Variables in the Manufacture of Polyalphaolefins*, Bracknell England, vol. 5–3, pp. 187–196.

*Primary Examiner*—Ellen M. McAvoy
(74) *Attorney, Agent, or Firm*—Louis N. Moreno; Andrew B. Griffis

(57) ABSTRACT

The present invention relates to a fully formulated lubicants comprising poly α-olefins (PAOs), prepared from a mixed α-olefin feed, which exhibit superior Noack volatility at low pour points, and methods for preparing the fully formulated lubricants. The fully formulated lubricants include PAOs that include mixtures of 1-decene and 1-dodecene. The PAOs may be prepared by polymerization/oligomerization using an alcohol promoted $BF_3$ in conjunction with a combination of co-catalysts.

52 Claims, No Drawings

U.S. PATENT DOCUMENTS 3,519,565 A 7/1970 Coleman ..... 508/297
3,541,012 A 11/1970 Stuebe ..... 508/243
3,565,804 A 2/1971 Honnen et al. ..... 508/259
3,576,898 A 4/1971 Blake ..... 260/676
3,630,904 A 12/1971 Musser et al. ..... 508/225
3,632,511 A 1/1972 Liano ..... 508/240
3,652,616 A 3/1972 Watson et al. ..... 556/62
3,666,730 A 5/1972 Coleman ..... 528/373
3,687,849 A 8/1972 Abbott ..... 508/312
3,697,574 A 10/1972 Piasek et al. ..... 558/292
3,702,300 A 11/1972 Coleman ..... 508/468
3,703,536 A 11/1972 Piasek et al. ..... 558/294
3,704,308 A 11/1972 Piasek et al. ..... 558/294
3,725,277 A 4/1973 Worrel ..... 508/542
3,725,480 A 4/1973 Traise et al. ..... 564/367
3,726,882 A 4/1973 Traise et al. ..... 546/304
3,742,082 A 6/1973 Brennan ..... 585/255
3,751,365 A 8/1973 Piasek et al. ..... 508/195
3,755,433 A 8/1973 Miller ..... 508/559
3,756,953 A 9/1973 Piasek et al. ..... 508/195
3,763,244 A 10/1973 Shubkin ..... 260/676 R
3,769,363 A 10/1973 Brennan ..... 585/255
3,770,854 A 11/1973 Morris et al. ..... 558/129
3,780,128 A 12/1973 Shubkin ..... 585/12
3,787,374 A 1/1974 Adams ..... 525/334.1
3,798,165 A 3/1974 Piasek et al. ..... 508/552
3,803,039 A 4/1974 Piasek et al. ..... 508/453
3,822,209 A 7/1974 Knapp et al. ..... 508/259
3,876,720 A 4/1975 Heilman et al. ..... 585/16
3,948,800 A 4/1976 Meinhardt ..... 516/31
3,965,018 A 6/1976 Heilman et al. ..... 252/59
4,032,591 A 6/1977 Cupples et al. ..... 260/683.65
4,045,507 A 8/1977 Cupples et al. ..... 585/511
4,045,508 A * 8/1977 Cupples et al. ..... 585/511
4,100,082 A 7/1978 Clason et al. ..... 508/412
4,172,855 A 10/1979 Shubkin et al. ..... 585/16
4,218,330 A 8/1980 Shubkin ..... 508/294
4,234,435 A 11/1980 Meinhardt et al. ..... 508/192
4,239,930 A 12/1980 Allphin et al. ..... 585/517
4,367,352 A 1/1983 Watts, Jr. et al. ..... 585/254
4,405,507 A 9/1983 Carr et al. ..... 252/466 B
4,405,508 A 9/1983 Eckel ..... 252/518
4,409,415 A 10/1983 Morganson et al. ..... 585/525
4,413,156 A 11/1983 Watts, Jr. et al. ..... 585/254
4,426,305 A 1/1984 Malec ..... 508/192
4,436,947 A 3/1984 Morganson et al. ..... 585/525
4,454,059 A 6/1984 Pindar et al. ..... 508/542
4,501,678 A 2/1985 Katayama et al. ..... 508/364
4,594,172 A 6/1986 Sie ..... 508/312
4,604,491 A 8/1986 Dressler et al. ..... 585/26
4,658,072 A 4/1987 Johnson ..... 585/24
4,714,794 A 12/1987 Yoshida et al. ..... 585/26
4,758,362 A 7/1988 Butke ..... 508/229
4,767,551 A 8/1988 Hunt et al. ..... 508/292
4,798,684 A 1/1989 Salomon ..... 508/251
4,827,064 A 5/1989 Wu ..... 585/10
4,827,073 A 5/1989 Wu ..... 585/530
4,897,178 A 1/1990 Best et al. ..... 208/111.3
4,910,355 A 3/1990 Shubkin et al. ..... 585/255
4,914,254 A 4/1990 Pelrine ..... 585/530
4,921,594 A 5/1990 Miller ..... 208/58
4,926,004 A 5/1990 Pelrine et al. ..... 585/530
4,943,672 A 7/1990 Hamner et al. ..... 585/737
4,950,822 A * 8/1990 Dileo et al. ..... 585/310
4,956,122 A 9/1990 Watts et al. ..... 508/485
4,967,032 A 10/1990 Ho et al. ..... 585/255
4,975,177 A 12/1990 Garwood et al. ..... 208/27
5,034,141 A 7/1991 Beltzer et al. ..... 508/378
5,034,142 A 7/1991 Habeeb et al. ..... 508/378
5,055,626 A 10/1991 Ho et al. ..... 585/416
5,068,487 A 11/1991 Theriot ..... 585/510
5,084,197 A 1/1992 Galic et al. ..... 508/295
5,110,445 A 5/1992 Chen et al. ..... 208/96
5,135,638 A 8/1992 Miller ..... 208/27
5,246,566 A 9/1993 Miller ..... 208/27
5,264,116 A 11/1993 Apelian et al. ..... 208/111.1
5,275,719 A 1/1994 Baker, Jr. et al. ..... 208/58
5,288,395 A 2/1994 Marler et al. ..... 208/58
5,302,279 A 4/1994 Degnan et al. ..... 208/87
5,344,578 A 9/1994 Wei et al. ..... 508/569
5,358,628 A 10/1994 Apelian et al. ..... 208/60
5,362,378 A 11/1994 Borghard et al. ..... 208/138
5,371,248 A 12/1994 Rudnick ..... 549/460
5,395,538 A 3/1995 Rudnick et al. ..... 508/221
5,453,556 A * 9/1995 Chang et al. ..... 585/524
5,468,368 A 11/1995 Baker, Jr. et al. ..... 208/58
5,552,071 A 9/1996 Rudnick et al. ..... 508/581
5,565,086 A 10/1996 Cody et al. ..... 208/27
5,602,086 A 2/1997 Le et al. ..... 508/591
5,643,440 A 7/1997 Borghard et al. ..... 208/58
5,693,598 A 12/1997 Abraham et al. ..... 508/444
5,705,458 A 1/1998 Roby et al. ..... 508/445
5,885,438 A 3/1999 Apelian et al. ..... 208/27
6,034,039 A 3/2000 Gomes et al. ..... 508/331
6,080,301 A 6/2000 Berlowitz et al. ..... 208/18
6,313,077 B1 * 11/2001 Stunnenberg et al. ..... 508/591
6,586,374 B1 * 7/2003 Paul ..... 508/214
6,646,174 B2 * 11/2003 Clarembeau ..... 585/525
6,680,417 B2 * 1/2004 Bagheri et al. ..... 585/523
2002/0137636 A1 9/2002 Hartley et al. ..... 508/110

* cited by examiner

FUNCTIONAL FLUID LUBRICANT USING LOW NOACK VOLATILITY BASE STOCK FLUIDS

FIELD OF THE INVENTION

This invention belongs to the field of lubricants. More particularly, this invention relates to certain improved lubricant formulations using poly α-olefins prepared from a mixed feed of olefins or comprise highly saturated, highly paraffinic, essentially non-cyclic hydrocarbons, individually or in combination.

BACKGROUND OF THE INVENTION

Poly α-olefins comprise one class of hydrocarbon lubricants that has achieved importance in the lubricating oil market. These materials are typically produced by the polymerization of α-olefins typically ranging from 1-octene to 1-dodecene, with 1-decene being a preferred material. Polymers of lower olefins such as ethylene and propylene may also be used, including copolymers of ethylene with higher olefins, as described in U.S. Pat. No. 4,956,122 and the patents referred to therein. The poly α-olefin (PAO) products may be obtained with a wide range of viscosities varying from highly mobile fluids of about 2 cSt at 100° C. to higher molecular weight, viscous materials that have viscosities exceeding 100 cSt at 100° C. The PAOs may be produced by the polymerization of olefin feed in the presence of a catalyst such as AlCl3, BF3, or BF3 complexes. Processes for the production of PAO lubricants are disclosed, for example, in the following U.S. Pat. Nos. 3,382,291; 4,172,855; 3,742,082; 3,780,128; 3,149,178; and 4,956,122. The PAO lubricants are also discussed in Lubrication Fundamentals, J. G. Wills, Marcel Dekker Inc., (New York, 1980). Subsequent to the polymerization of the α-olefin, the lubricant range products are hydrogenated to reduce the residual unsaturation. In the course of the hydrogenation, the amount of unsaturation is generally reduced by greater than 90%.

PAOs having a viscosity of 4 cSt are typically made from 1-decene and have a Noack volatility of 13–16% and pour point of less than −60° C. Certain conventional PAOs having a viscosity of 5 cSt are typically made from 1-decene and have a Noack volatility of about 9% and a pour point of less than about −57° C. PAOs having a viscosity of 6 cSt are typically prepared from 1-decene or a blend of α-olefins and have a Noack volatility of about 7% and pour point of about −60° C. These PAOs may be used alone or in conjunction with another material that serves as a base stock. The fully formulated engine oil may include at least a portion of a co-base stock.

A major trend in passenger car engine oil usage is the extension of oil drain intervals. Because engine oil users do not regularly check engine oil level and top off with supplement oil when needed, a need exists for lubricants that exhibits low Noack volatility to control oil consumption. (See ASTM D5800 Standard Test Method for Evaporation Loss of Lubricating Oils by the Noack Method.)

There also exists a need for a fully formulated engine oil that has a lower viscosity increase and viscosity after use for a given period of time when compared to conventional engine oils to maximize engine oil useful life. There is also a need for fully formulated engine oils with exceptional low temperature performance.

PAOs are one family of lubricants that provide extremely good Noack performance and simultaneously provide excellent low temperature properties and thus are an ideal fluid for extended drain applications.

The properties of a particular grade of PAO are greatly dependent on the α-olefin used to make that product. In general, the higher the carbon number of the α-olefin, the lower the Noack volatility and the higher the pour point of the product.

SUMMARY OF THE INVENTION

One embodiment of the present invention relates to formulated engine oils having base stocks, including, but not limited to, poly α-olefins that exhibit superior Noack volatility, while maintaining good low temperature properties. Mixtures of linear α-olefins, exemplified by 1-decene and 1-dodecene, are polymerized by methods, which include using BF3 promoted alcohol/ester mixture. The reaction mixture is distilled to remove the unreacted monomeric and dimeric species. The resulting product is typically hydrogenated to saturate the oligomers, to provide a product having a desired viscosity, for example 5 cSt. This product is distilled and distillation cuts blended to provide PAOs of varying viscosity grades. A 5 cSt co-oligomeric PAO comprises one component of a fully formulated engine oil having a base stock and, optionally, an additive package.

One embodiment according to the present invention provides an engine oil comprising a 5 cSt PAO prepared from a mixed 1-decene and 1-dodecene olefin feed and a 4 cSt PAO prepared from 1-decene. In another embodiment according to the present invention, the engine oil may further comprise an additives package. The additives package comprises individual components or combinations of two or more components selected from a detergent, an anti-wear additive, an extreme pressure additive, a viscosity index improver, an anti-oxidant, a dispersant, a pour point depressant, a corrosion inhibitor, a seal compatibility additive, and an anti-foam agent and/or an inhibitor.

One embodiment according to the present invention comprises iso-paraffinic base stocks designated iPBO-5 which are highly iso-paraffinic, having the following properties:

a) percent total paraffinic carbon (% CP) greater than 90 wt %, preferably greater than 95 wt %, based on the total weight of the iPBO-5;

b) percent total aromatic carbon (% CA) less than 2 wt %, preferably less than 1.5 wt %, more preferably less than 1 wt % based on the total weight of the iPBO-5;

c) low bromine number, less than 5, preferably less than 3, more preferably <1.5 or low iodine number, less than 5, preferably less than 3;

d) pour point <−48° C.; and e) viscosity index greater than 100, preferably greater that 110, and more preferably greater than 120.

In one aspect, the present invention provides a process for preparing fully formulated engine oils, the process comprising the steps:

(a) preparing a 5 cSt PAO by the steps of (1) oligomerizing an α-olefin feed, wherein said feed is comprising 40 to 80 weight percent of 1-decene and 60 to 20 weight percent of 1-dodecene, in the presence of BF3 and at least two different co-catalysts, wherein said co-catalysts are selected from groups (i) and (ii):

(i) alcohols, and (ii) alkyl acetates, provided that at least one co-catalyst is from group (i) and at least one co-catalyst is from group (ii); followed by (2) hydrogenation of at least a portion of residual unsaturation;

(b) blending the 5 cSt PAO with a 4 cSt PAO to form a mixed PAO composition; and (c) optionally blending a base stock with the mixed PAO composition.

In another embodiment according to the present invention, the α-olefin feed consists essentially of 40 to 80 weight percent of 1-decene and 60 to 20 weight percent of 1-dodecene.

DETAILED DESCRIPTION OF THE INVENTION

The present invention relates to formulated engine oils having base stocks, including, but not limited to, poly α-olefins that exhibit superior Noack volatility, while maintaining good low temperature properties.

Lubricating base stocks useful in the present invention comprise highly saturated, highly paraffinic, essentially non-cyclic hydrocarbons, and additionally, comprises highly iso-paraffinic hydrocabons, with a base stock kinematic viscosity at 100° C. of about 3.5 cSt to about 6.5 cSt, preferably with a base stock kinematic viscosity at 100° C. of about 4.5 cSt to about 5.5 cSt, more preferably with base stock kinematic viscosity at 100° C. of about 4.8 cSt to about 5.2 cSt. Members of a class of such predominantly iso-paraffinic base stocks (iPBO) with a kinematic viscosity of 5 cSt at 100° C. are designated iPBO-5.

iPBO-5 are highly iso-paraffinic, with the following properties:

a) percent total paraffinic carbon (% CP) greater than 90 wt %, preferably greater than 95 wt %, based on the total weight of the iPBO-5;

b) percent total aromatic carbon (% CA) less than 2 wt %, preferably less than 1.5 wt %, more preferably less than 1 wt % based on the total weight of the iPBO-5;

c) low bromine number, less than 5, preferably less than 3, more preferably <1.5 or low iodine number, less than 5, preferably less than 3;

d) pour point <−48° C.; and e) viscosity index greater than 100, preferably greater that 110, and more preferably greater than 120.

Examples of iPBO-5 may include base stocks derived from mineral or petroleum carbon-based sources (via purification processes such as, for example, separation, distillation, hydrotreating, hydrofinishing) and from synthetic carbon-based sources (via chemical processes where carbon-carbon bonds are newly created and/or existing carbon-carbon bonds are rearranged).

Examples of iPBO-5 may include poly α-olefin (PAO) base stocks, for example PAO base stock with kinematic viscosity at 100° C. of about 4.5 cSt to about 5.5 cSt, so called PAO-5, more preferably with kinematic viscosity at 100° C. of about 4.8 cSt to about 5.2 cSt Examples of iPBO-5 may include base stocks derived by hydroisomerization of hydrocarbon waxes (mineral or synthetic waxes, for example, slack waxes, Fischer-Tropsch waxes, gas-to-liquids waxes), and may include base stocks such as, for example, wax-derived hydroisomerized base stocks, wax isomerates (WI), Fischer-Tropsch lube (FTL) base stocks, Gas-to-Liquids (GTL) lube base stocks, and other such base stocks possessing the above properties. For example, such base stocks examples having kinematic viscosity at 100° C. as described above, may be known as WI-5, FTL-5, and GTL-5, respectively.

The engine oils according to one aspect of the present invention, which use a blend of 4 cSt PAO, prepared from essentially a single α-olefin, and a 5 cSt PAO, prepared from a mixed olefin feed, provide a low viscosity PAO that exhibits low Noack volatility and exceptional low temperature performance. A fully formulated engine oil according to this aspect of the present invention has a lower viscosity increase after use for a given period of time when compared to conventional engine oils.

In another embodiment the present invention provides for a process for preparing a fully formulated engine oil comprising blending (a) a 5 cSt PAO comprising 40 to 80 weight percent of 1-decene and 60 to 20 weight percent of 1-dodecene; and (b) a 4 cSt PAO to form a mixed PAO composition. Alternatively, the 5 cSt PAO consists essentially of 40 to 80 weight percent of 1-decene and 60 to 20 weight percent of 1-dodecene.

In another aspect, the present invention provides a fully formulated engine oil, which comprises a 5 cSt PAO comprising 40 to 80 weight percent of 1-decene and 60 to 20 weight percent of 1-dodecene, a 4 cSt PAO and a base stock. Alternatively, in another embodiment, the present invention provides a fully formulated engine oil, which comprises a 5 cSt PAO consisting essentially of 40 to 80 weight percent of 1-decene and 60 to 20 weight percent of 1-dodecene, a 4 cSt PAO and a base stock.

Another embodiment according to the present invention provides a fully formulated engine oil, which comprises a 5 cSt PAO comprising 40 to 80 weight percent of 1-decene and 60 to 20 weight percent of 1-dodecene, a second PAO having a viscosity less than about 5 cSt, preferably less than or equal to about 4 cSt and a base stock. Another embodiment according to the present invention provides a fully formulated engine oil, which comprises a 5 cSt PAO consisting essentially of 40 to 80 weight percent of 1-decene and 60 to 20 weight percent of 1-dodecene, a second PAO having a viscosity less than about 5 cSt, preferably less than or equal to about 4 cSt and a base stock.

Another embodiment according to the present invention provides fully formulated engine oils further comprising at least one additive selected from a detergent, an anti-wear additive, an extreme pressure additive, a viscosity index improver, an anti-oxidant, a dispersant, a pour point depressant, a corrosion inhibitor, a seal compatibility additive, a friction reducer, and an anti-foam agent. The additives may be used individually or in any combination to provide the desired performance characteristics for the fully formulated engine oil.

In one aspect of the present invention, the 4 cSt PAO may have a Noack volatility of from about 9 to about 16 percent weight loss and may have a pour point of from about −45° C. to about −65° C.

Another embodiment according to the present invention provides a fully formulated engine oil comprising (a) a conventional lubricant base stock, (b) at least one 5 cSt PAO lubricant comprising an oligomerized α-olefin which has been subjected to hydrogenation, and (c) a 4 cSt PAO, wherein said oligomerized α-olefin is prepared from an olefin feed comprising 40 to 80 weight percent of 1-decene and 60 to 20 weight percent 1-dodecene, wherein said oligomerized α-olefin exhibits a Noack volatility of about 4 to 12% weight loss and a pour point of about −40° C. to −65° C. Alternatively, the olefin feed may consist essentially of 40 to 80 weight percent of 1-decene and 60 to 20 weight percent 1-dodecene.

In the above compositions and processes, it is preferred that the α-olefin feed consists essentially of 40 to 80 weight percent of 1-decene and 60 to 20 weight percent of 1-dodecene, with 50 to 75 weight percent of 1-decene and 50 to 25 weight percent of 1-dodecene being more preferred. We have found that a combination of co-catalysts (or promoters), one co-catalyst selected from (i) the class of alcohols, i.e., compounds having one hydroxyl functional group, preferably C1–C10 alcohols, more preferably C1–C6 alcohols, and at least one co-catalyst selected from (ii) alkyl acetates, preferably C1–C10 alkyl acetates, more preferably C1–C6 alkyl acetates, provides oligomers which possess desired distributions and physical properties. In this regard, we have found that PAOs prepared from either group (i) or (ii) alone exhibit low product yields.

In this process, it is preferred that the ratio of the group (i) co-catalysts to group (ii) co-catalysts range from about 0.2 to 15, [i.e., (i):(ii)] with 0.5 to 7 being preferred.

Preferred C1–C6 alcohols include methanol, ethanol, n-propanol, n-butanol, n-pentanol, and n-hexanol.

Preferred C1–C6 alkyl acetates include methyl acetate, ethyl acetate, n-propyl acetate, n-butyl acetate, and the like.

We have found that, surprisingly, the products of this process possess a good balance of properties, especially low Noack volatility and pour point. Thus, in a preferred embodiment, the present invention provides a lubricant which possesses a Noack volatility of about 4 to 12% weight loss, alternatively 6 to 10% weight loss, as determined by a modified ASTM D5800 method, and a pour point of about −40° C. to −65° C., alternatively −50° to −58° C., as determined by a modified ASTM D5950 method;

wherein said modified ASTM D5800 method is an ASTM D5800 method with the exception that thermometer calibration is performed annually;

and wherein said modified ASTM D5950 method is an ASTM D5950 method with the exception that the sample to be tested is not heated prior to performing said method.

In this regard, the modified ASTM D5800 method is the same as the ASTM D5800 method, with the exception that the thermometer calibration is performed annually rather than biannually. The modified ASTM D5950 method is the same as the ASTM D5950 method with the exception that the sample to be tested is not heated prior to performing said method. In particular, the preliminary preheat of the test specimen, as set forth in 11.3.1 and 11.3.2, in ASTM D5950, is not followed.

The oligomerized α-olefins used in the fully formulated engine oils of the present invention are preferably subjected to hydrogenation using conventional hydrogenation methodology to reduce at least a portion of the residual unsaturation which remains after the oligomerization. In this regard, typical hydrogenation catalysts such as Pd, Pt, Ni, etc., can be utilized. In the hydrogenation step, it is preferred that at least about 90% of the residual unsaturation be reduced. The lubricants thus provided may be utilized as is in lubricant applications or may be formulated with other conventional lubricants. Accordingly, in another aspect, the present invention provides a fully formulated engine oil comprising:

(a) a conventional lubricant base stock; and (b) a 5 cSt PAO comprising an oligomerized α-olefin which has been subjected to hydrogenation, wherein said oligomerized α-olefin is prepared from an olefin feed comprising 40 to 80 weight percent of 1-decene and 60 to 20 weight percent 1-dodecene, wherein said oligomerized α-olefin exhibits a Noack volatility of about 4 to 12% weight loss, as determined by a modified ASTM D5800 method, and a pour point of about −40° C. to −65° C. as determined by a modified ASTM D5950 method;

wherein said modified ASTM D5800 method is an ASTM D5800 method with the exception that thermometer calibration is performed annually;

and wherein said modified ASTM D5950 method is an ASTM D5950 method with the exception that the lubricant to be tested is not heated prior to performing said method.

In the above fully formulated engine oil, suitable conventional lubricant base stocks include known synthetic and natural lubricants which may form a major or minor portion of the overall lubricant composition and their choice and quantity can be tailored to meet desired end-use criteria. [See, for example, Synthetic Lubricants and High-Performance Functional Fluids, Ed. Ronald L. Shubkin, Marcel Dekker, Inc., (New York, 1993)].

The oligomerization reaction can be conducted in a single or multiple stage process to produce a mixture of dimer, trimer, tetramer, and pentamer products. The product of the oligomerization reaction can be subjected to fractional distillation to afford products via blending having viscosities in the range of from about 4 cSt to about 6 cSt at 100° C., for example, 4, 5, and 6 cSt.

In one embodiment according to the present invention, boron trifluoride is used as the catalyst in the process of the present invention along with a combination of co-catalysts. As noted above, we have found that surprisingly, when one selects at least one catalyst from the classes of alcohols and at least one selected from alkyl acetates, followed by conventional hydrogenation, a lubricant having a superior balance of properties results. The co-catalyst complexes with the boron trifluoride to form a coordination compound which is catalytically active. In a preferred embodiment, the co-catalyst is used in an amount of from about 0.01 to about 10 weight percent, based on the weight of the α-olefin feed, most preferably about 0.1 to 6 weight percent.

It is preferred that the boron trifluoride be introduced into the reactor simultaneously with co-catalysts and olefin feed. It is further preferred that the reaction zone contains an excess of boron trifluoride, which is governed by the pressure and partial pressure of the boron trifluoride. In this regard, it is preferred that the boron trifluoride be maintained in the reaction zone at a pressure of about 2 to about 500 psig, preferably about 2 to 50 psig. Alternatively, the boron trifluoride can be sparged into the reaction mixture, along with other known methods for introducing the boron trifluoride to the reaction zone.

Suitable temperatures for the reaction are also conventional and can vary from about −20° C. to about 90° C., with a range of about 15° to 70° C. being preferred.

Further details regarding suitable conventional processing methodologies can be found in U.S. Pat. No. 4,045,507, incorporated herein by reference, and in Synthetic Lubricants and High-Performance Functional Fluids, Ed. Ronald L. Shubkin, Marcel Dekker, Inc., (New York, 1993).

The formulated engine oils may also include a performance additives package. The additives package may include a detergent, a dispersant and/or an inhibitor. The fully formulated engine oils according to the present invention comprise a mixed feed PAO and provide improved performance as shown by, for example, the Volkswagen T-4 test results.

The engine oils of the present invention may also utilize a co-base stock, which comprises a hydrocarbon base stock component of lubricating viscosity. This component may be saturated in character with a viscosity index of 110 or greater and have a sulfur content generally below 0.03 weight percent and a total aromatics and olefinic content of below 10 weight percent each. Hydrocarbon base stock components of this type include oils of mineral origin in API Group III (as well as certain oils in Group II), the Group IV synthetic base stocks (PAOs) and other synthetic hydrocarbon base stocks in API Group V. The preferred hydrocarbon base stock components of this type are the poly α-olefins (PAOs) of API Group IV. At least 50% of the total lubricant comprises the primary hydrocarbon component and generally, the amount of this component is at least 60% of the total base stock. In preferred compositions, this component comprises at least 75% of the total composition.

This co-base stock component may be a conventional lubricant base stock, which includes synthetic materials or materials of mineral oil origin, although the synthetic materials are preferred. Suitable mineral oil stocks are characterized by a predominantly saturated (paraffinic) composition, relative freedom from sulfur and a high viscosity index (ASTM D2270), greater than 110. Saturates (ASTM D2007) are at least 90 weight percent and the controlled sulfur content is not more than 0.03 weight percent (ASTM D2622, D4294, D4927, D3120). Base stock components of this type of mineral oil origin include the hydroprocessed stocks, especially hydrotreated and catalytically hydrodewaxed distillate stocks, catalytically hydrodewaxed raffinates, hydrocracked and hydroisomerized petroleum waxes, including the lubricating oils referred to as XHVI oils, as well as other oils of mineral origin generally classified as API Group III base stocks. Exemplary streams of mineral origin which may be converted into suitable high quality base stocks by hydroprocessing techniques include waxy distillate stocks such as gas oils, slack waxes, deoiled waxes and microcrystalline waxes, and fuels hydrocracker bottoms fractions. Processes for the hydroisomerization of petroleum waxes and other feeds to produce high quality lubestocks are described in U.S. Pat. Nos. 5,885,438; 5,643,440; 5,358,628; 5,302,279; 5,288,395; 5,275,719; 5,264,116; and 5,110,445, which are fully incorporated by reference. The production of very high quality lubricant base stocks of high viscosity index from fuels hydrocracker bottoms is described in U.S. Pat. No. 5,468,368, which is fully incorporated by reference.

Synthetic hydrocarbon base stocks include the poly α-olefins (PAOs) and the synthetic oils from the hydrocracking or hydroisomerization of Fischer-Tropsch high boiling fractions including waxes. These are both stocks comprised of saturates with low impurity levels consistent with their synthetic origin. Other useful lubricant oil base stocks include wax isomerate base stocks, comprising hydroisomerized waxy stocks (e.g. waxy stocks such as gas oils, slack waxes, fuels hydrocracker bottoms, etc.), hydroisomerized Fischer-Tropsch waxes, Gas-to-Liquids (GTL) base stocks, and other wax-derived hydroisomerized base stocks, or mixtures thereof. Fischer-Tropsch waxes, the high boiling point residues of Fischer-Tropsch synthesis, are highly paraffinic hydrocarbons with very low sulfur content. The hydroprocessing used for the production of such base stocks may use an amorphous hydrocracking/hydroisomerization catalyst, such as one of the specialized lube hydrocracking (LHDC) catalysts or a crystalline hydrocracking/hydroisomerization catalyst, preferably a zeolitic catalyst. For example, one useful catalyst is ZSM-48 as described in U.S. Pat. No. 5,075,269, incorporated herein in its entirety by reference. Processes for making hydrocracked/hydroisomerized distillates and hydrocracked/hydroisomerized waxes are described, for example, in U.S. Pat. Nos. 2,817,693; 4,975,177; 4,921,594; and 4,897,178, as well as in British Patents 1,429,494; 1,350,257; 1,440,230; and 1,390,359, also incorporated herein by reference in their entirety. Particularly favorable processes are described in European Patent Applications 464 546 and 464 547, also incorporated herein. Processes using Fischer-Tropsch wax feeds are described in U.S. Pat. Nos. 4,594,172 and 4,943,672, incorporated herein by reference in their entirety.

Gas-to-Liquids (GTL) base stocks, Fischer-Tropsch wax derived base stocks, and other wax-derived hydroisomerized (wax isomerate) base stocks may be advantageously used in the instant invention, and may have useful kinematic viscosities at 100° C. of about 3 cSt to about 50 cSt, preferably about 3 cSt to about 30 cSt, more preferably about 3.5 cSt to about 25 cSt, as exemplified by GTL5 with kinematic viscosity of about 5 cSt at 100° C. and a viscosity index of about 140. These Gas-to-Liquids (GTL) base stocks, Fischer-Tropsch wax derived base stocks, and other wax-derived hydroisomerized base stocks may have useful pour points of about −20° C. or lower, and under some conditions may have advantageous pour points of about −25° C. or lower, with useful pour points of about −30° C. to about −40° C. or lower. Useful compositions of Gas-to-Liquids (GTL) base stocks, Fischer-Tropsch wax derived base stocks, and wax-derived hydroisomerized base stocks are recited in U.S. Pat. Nos. 6,080,301; 6,090,989; and 6,165,949, for example, and are incorporated herein in their entirety by reference.

The hydroisomerized Fischer-Tropsch waxes are highly suitable base stocks, comprising saturated components of iso-paraffinic character (resulting from the isomerization of the predominantly n-paraffins of the Fischer-Tropsch waxes), which give a good blend of high viscosity index and low pour point. Processes for the hydroisomerization of Fischer-Tropsch waxes are described in U.S. Pat. Nos. 5,362,378; 5,565,086; 5,246,566; and 5,135,638; as well as in EP 710 710, EP 321 302, and EP 321 304, which are fully incorporated by reference.

Gas-to-Liquids (GTL) base stocks, Fischer-Tropsch wax derived base stocks, have a beneficial kinematic viscosity advantage over conventional Group II and Group III base stocks, which may be very advantageously used with the instant invention. Gas-to-Liquids (GTL) base stocks can have significantly higher kinematic viscosities, up to about 20–50 cSt at 100° C., whereas by comparison commercial Group II base stocks can have kinematic viscosities, from about 3 cSt to about 15 cSt at 100° C., and commercial Group III base stocks can have kinematic viscosities, from about 3 cSt to about 10 cSt at 100° C. The higher kinematic viscosity range of Gas-to-Liquids (GTL) base stocks, compared to the more limited kinematic viscosity range of Group II and Group III base stocks, in combination with the instant invention can provide additional beneficial advantages in formulating lubricant compositions. Also, the exceptionally low sulfur content of Gas-to-Liquids (GTL) base stocks, and other wax-derived hydroisomerized base stocks, in combination with the low sulfur content of suitable olefin oligomers and/or alkyl aromatics base stocks, and in combination with the instant invention can provide additional advantages in lubricant compositions where very low overall sulfur content can beneficially impact lubricant performance. In another aspect, Gas-to-Liquids (GTL) base stocks have advantageously low NOACK volatility, and in combination with the instant invention can provide additional advantages in lubricant compositions.

Many of the preferred wax isomerate base stocks, as described above, are characterized as having predominantly saturated (paraffinic) compositions, and are further characterized as having many of the following properties: high saturates levels, low-to-nil sulfur, low-to-nil nitrogen, low-to-nil aromatics carbon, low concentrations of naphthenic carbon, high concentrations of paraffinic carbon, low bromine number, high aniline point, high viscosity index (preferably 110 or above), and essentially water-white color.

The PAOs, prepared from single olefin feeds, are known materials and typically comprise relatively low molecular weight hydrogenated polymers or oligomers of α-olefins which include but are not limited to C2 to about C32 α-olefins with the C8 to about C16 α-olefins, such as 1-octene, 1-decene, 1-dodecene and the like being preferred. The preferred poly α-olefins are poly-1-decene and poly-1-dodecene although the dimers of higher olefins in the range of C14 to C18 provide low viscosity base stocks.

The PAO fluids may be conveniently made by the polymerization of an α-olefin in the presence of a polymerization catalyst such as the Friedel-Crafts catalysts including, for example, aluminum trichloride, boron trifluoride or complexes of boron trifluoride either with water, alcohols such as ethanol, propanol or butanol, carboxylic acids or with esters such as ethyl acetate or ethyl propionate. For example the methods disclosed by U.S. Pat. No. 4,149,178 or U.S. Pat. No. 3,382,291 may be conveniently used herein and which are fully incorporated by reference. Other descriptions of PAO synthesis are found in the following U.S. Pat. No. 3,742,082 (Brennan); U.S. Pat. No. 3,769,363 (Brennan); U.S. Pat. No. 3,876,720 (Heilman); U.S. Pat. No. 4,239,930 (Allphin); U.S. Pat. No. 4,367,352 (Watts); U.S. Pat. No. 4,413,156 (Watts); U.S. Pat. No. 4,434,408 (Larkin); U.S. Pat. No. 4,910,355 (Shubkin); U.S. Pat. No. 4,956,122 (Watts); and U.S. Pat. No. 5,068,487 (Theriot), which are fully incorporated by reference. A particularly favorable class of PAO type base stocks is the High Viscosity Index PAOs (HVI-PAOs) prepared by the action of a reduced chromium catalyst with the α-olefin; the HVI-PAOs are described in U.S. Pat. No. 4,827,073 (Wu); U.S. Pat. No. 4,827,064 (Wu); U.S. Pat. No. 4,967,032 (Ho et al.); U.S. Pat. No. 4,926,004 (Pelrine et al.); and U.S. Pat. No. 4,914,254 (Pelrine), which are fully incorporated by reference. The dimers of the C14 to C18 olefins are described in U.S. Pat. No. 4,218,330, which is fully incorporated by reference.

The average molecular weight of the PAO typically varies from about 250 to about 10,000 with a preferred range of from about 300 to about 3,000 and with a viscosity varying from about 2 cSt to about 200 cSt, preferably from about 4 cSt to about 10 cSt at 100° C. The PAO, being the majority, i.e., greater than 50 wt %, component of the formulation will have the greatest effect on the viscosity and other viscometric properties of the finished product. Since the finished lubricant products are sold by viscosity grade, blends of different PAOs may be used to achieve the desired viscosity grade. Typically, the PAO component will comprise one or more PAOs of varying viscosities, usually with the lightest component being nominally a 2 cSt (100° C.) component with other, more viscous PAOs also being present in order to give the final desired viscosity to the finished formulation. Typically, PAOs may be made in viscosities up to about 1,000 cSt (100° C.) although in most cases, viscosities greater than 100 cSt will not be required except in minor amounts.

In addition to the primary hydrocarbon component the base stock may also include a secondary liquid component with desirable lubricant properties. The preferred members of this class are the hydrocarbon substituted aromatic compounds, such as the long chain alkyl substituted aromatics. The preferred hydrocarbon substituents for all these materials are, of course, the long chain alkyl groups with at least 8 and usually at least 10 carbon atoms, to confer good solubility in the primary hydrocarbon blend component. Alkyl substituents of 12 to 18 carbon atoms are suitable and can readily be incorporated by conventional alkylation methods using olefins or other alkylating agents. The aromatic portion of the molecule in one embodiment is hydrocarbon or non-hydrocarbon as in the examples given below.

Included in this class of base stock blend components are, for example, long chain alkylbenzenes and long chain alkylnaphthalenes which are particularly preferred materials since they are hydrolytically stable and may therefore be used in combination with the PAO component of the base stock in wet applications. The alkylnaphthalenes are known materials and are described, for example, in U.S. Pat. No. 4,714,794 (Yoshida et al.), which is fully incorporated by reference. The use of a mixture of monoalkylated and polyalkylated naphthalene as a base for synthetic functional fluids is also described in U.S. Pat. No. 4,604,491(Dressler), which is fully incorporated by reference. The preferred alkylnaphthalenes are those having a relatively long chain alkyl group typically from 10 to 40 carbon atoms although longer chains may be used if desired. Alkylnaphthalenes produced by alkylating naphthalene with an olefin of 14 to 20 carbon atoms has particularly good properties, especially when zeolites such as the large pore size zeolites are used as the alkylating catalyst, as described in U.S. Pat. No. 5,602,086, corresponding to EP 496 486 to which are incorporated by reference for a description of the synthesis of these materials. These alkylnaphthalenes are predominantly monosubstituted naphthalenes with attachment of the alkyl group taking place predominantly at the 1- or 2-position of the alkyl chain. The presence of the long chain alkyl groups confers good viscometric properties on the alkylnaphthalenes, especially when used in combination with the PAO components, which are themselves materials of high viscosity index, low pour point and good fluidity.

An alternative secondary blending stock is an alkylbenzene or mixture of alkylbenzenes. The alkyl substituents in these fluids are typically alkyl groups of about 8 to 25 carbon atoms, usually from 10 to 18 carbon atoms and up to three such substituents may be present, as described in ACS Petroleum Chemistry Preprint 1053–1058, "Poly n-Alkylbenzene Compounds: A Class of Thermally Stable and Wide Liquid Range Fluids", Eapen et al, Phila. 1984. Tri-alkyl benzenes may also be produced by the cyclodimerization of 1-alkynes of 8 to 12 carbon atoms as described in U.S. Pat. No. 5,055,626, which is fully incorporated by reference. Other alkylbenzenes are described in EP 168 534 and U.S. Pat. No. 4,658,072, which are fully incorporated by reference. Alkylbenzenes have been used as lubricant base stocks, especially for low temperature applications (Arctic vehicle service and refrigeration oils) and in papermaking oils; they are commercially available from producers of linear alkylbenzenes (LABs) such as Vista Chem. Co, Huntsman Chemical Co., Chevron Chemical Co., and Nippon Oil Co. The linear alkylbenzenes typically have good low pour points and low temperature viscosities and VI values greater than 100 together with good solvency for additives. Other alkylated aromatics which may be used when desirable are described, for example, in "Synthetic Lubricants and High Performance Functional Fluids", Dressler, H., chap. 5, [R. L. Shubkin (Ed.)], Marcel Dekker, N.Y. 1993.

Also included in this class and with very desirable lubricating characteristics are the alkylated aromatic compounds including the alkylated diphenyl compounds such as the alkylated diphenyl oxides, alkylated diphenyl sulfides and alkylated diphenyl methanes and the alkylated phenoxathins as well as the alkylthiophenes, alkyl benzofurans and the ethers of sulfur-containing aromatics. Lubricant blend components of this type are described, for example, in U.S. Pat. Nos. 5,552,071; 5,171,195; 5,395,538; 5,344,578; 5,371,248; and EP 815 187, which are fully incorporated by reference.

The secondary component of the base stock is typically used in an amount no more than 40 wt. % of the total composition and in most cases will not exceed 25 wt. %. The alkylnaphthalenes are preferably used in amounts from about 3 to 25, usually 5 to 20 wt. %. Alkylbenzenes and other alkyl aromatics may be used in the same amounts although it has been found that the alkylnaphthalenes in some lubricant formulations are superior in oxidative performance in certain applications.

Although the present lubricants are usually hydrocarbon-based compositions, they may make use of minor amounts of other base stocks in certain applications, for example, to improve haze, solvency or seal swell even though in most cases, the alkylnaphthalene component will provide good performance in these areas. Examples of additional base stocks that may be present include the polyalkylene glycols (PAGs), and ester oils, both of which are conventional in type. The amount of such additional components should not normally exceed about 5 weight percent of the total composition. If haze values need to be improved, the presence of up to about 5 weight percent ester will normally correct the problem.

The esters that may be used for improving haze, solvency or seal swell include the esters of dibasic acids with monoalkanols and the polyol esters of monocarboxylic acids. Esters of the former type include, for example, the esters of dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, etc.

Particularly useful synthetic esters are those which are obtained by reacting one or more polyhydric alcohols, preferably the hindered polyols such as the neopentyl polyols, e.g., neopentyl glycol, trimethylol ethane, 2-methyl-2-propyl-1,3-propanediol, trimethylol propane, pentaerythritol and dipentaerythritol with alkanoic acids containing at least 4 carbon atoms such as C5 to C30 acids such as saturated straight chain fatty acids including caprylic acid, capric acid, lauric acid, myristic acid, palmitic acid, stearic acid, arachic acid, and behenic acid, or the corresponding branched chain fatty acids or unsaturated fatty acids such as oleic acid.

The most suitable synthetic ester oils are the esters of trimethylol propane, trimethylol butane, trimethylol ethane, pentaerythritol and/or dipentaerythritol with one or more monocarboxylic acids containing from about 5 to about 10 carbon atoms are widely available commercially, for example, the Mobil P-41 and P-51 esters (Mobil Chemical Company).

The viscosity grade of the final product is adjusted by suitable blending of base stock components of differing viscosities, together with the use of thickeners, if desired. Differing amounts of the various basestock components (primary hydrocarbon base stocks, secondary base stock and any additional base stock components) of different viscosities may be suitably blended together to obtain a base stock blend with a viscosity appropriate for blending with the other components of the finished lubricant. The viscosity grades for the final product may typically be in the range of ISO 20 to ISO 1000 or even higher for gear lubricant applications, for example, up to about ISO 46,000. For the lower viscosity grades, typically from ISO 20 to ISO 100, the viscosity of the combined base stocks will be slightly higher than that of the finished product, typically from ISO 22 to about ISO 120 but in the more viscous grades up to ISO 46,000, the additives will frequently decrease the viscosity of the base stock blend to a slightly lower value. With an ISO 680 grade lubricant, for example, the base stock blend might be about 780–800 cSt (40° C.) depending on the nature and content of the additives.

Other Lubricating Oil Components

In one embodiment, the instant invention is used with additional lubricant components in effective amounts in lubricant compositions, such as, for example, polar and/or non-polar lubricant base stocks, and performance additives, such as, for example, but not limited to, oxidation inhibitors, metallic and non-metallic dispersants, metallic and non-metallic detergents, corrosion and rust inhibitors, metal deactivators, anti-wear agents (metallic and non-metallic, phosphorus-containing and non-phosphorus, sulfur-containing and non-sulfur types), extreme pressure additives (metallic and non-metallic, phosphorus-containing and non-phosphorus, sulfur-containing and non-sulfur types), anti-seizure agents, pour point depressants, wax modifiers, viscosity modifiers, seal compatibility agents, friction modifiers, lubricity agents, anti-staining agents, chromophoric agents, defoamants, demulsifiers, and others.

For a review of many commonly used additives see Klamann in Lubricants and Related Products, Verlag Chemie, Deerfield Beach, Fla.; ISBN 0-89573-177-0, which gives a good discussion of a number of the lubricant additives discussed mentioned below. Reference is also made to "Lubricant Additives" by M. W. Ranney, published by Noyes Data Corporation of Parkridge, N.J. (1973).

Detergents

In one embodiment, the present invention is used in combination with other detergents. Suitable detergents include the alkali or alkaline earth metal salts of sulfates, phenates, carboxylates, phosphates, and salicylates.

Sulfonates may be prepared from sulfonic acids that are typically obtained by sulfonation of alkyl substituted aromatic hydrocarbons. Hydrocarbon examples include those obtained by alkylating benzene, toluene, xylene, naphthalene, biphenyl and their halogenated derivatives (chlorobenzene, chlorotoluene, and chloronaphthalene, for example). The alkylating agents typically have about 3 to 70 carbon atoms. The alkaryl sulfonates typically contain about 9 to about 80 carbon or more carbon atoms, more typically from about 16 to 60 carbon atoms.

Ranney in "Lubricant Additives" op cit discloses a number of overbased metal salts of various sulfonic acids that are useful as detergents and dispersants in lubricants. The book entitled "Lubricant Additives", C. V. Smallheer and R. K. Smith, published by the Lezius-Hiles Co. of Cleveland, Ohio. (1967), similarly discloses a number of overbased sulfonates, which are useful as dispersants/detergents.

Alkaline earth phenates are another useful class of detergent. These detergents are made by reacting alkaline earth metal hydroxide or oxide [CaO, Ca(OH)2, BaO, Ba(OH)2, MgO, Mg(OH)2, for example] with an alkyl phenol or sulfurized alkylphenol. Useful alkyl groups include straight chain or branched C1–C30 alkyl groups, preferably C4–C20. Examples of suitable phenols include isobutylphenol, 2-ethylhexylphenol, nonylphenol, 1-ethyldecylphenol, and the like. It should be noted that starting alkylphenols may contain more than one alkyl substituent that are each independently straight chain or branched. When a non-sulfurized alkylphenol is used, the sulfurized product may be obtained by methods well known in the art. These methods include heating a mixture of alkylphenol and sulfurizing agent (including elemental sulfur, sulfur halides such as sulfur dichloride, and the like) and then reacting the sulfurized phenol with an alkaline earth metal base.

Metal salts of carboxylic acids other than salicylic acid are also used as detergents. These carboxylic acid detergents are prepared by a method analogous to that used for salicylates.

Alkaline earth metal phosphates are also used as detergents.

Detergents may be simple detergents or what is known as hybrid or complex detergents. The latter detergents can provide the properties of two detergents without the need to blend separate materials. See U.S. Pat. No. 6,034,039, for example, which is incorporated herein by reference in its entirety. Typically, the total detergent concentration is about 0.01 to about 6.0 weight percent, preferably, 0.1 to 0.4 weight percent.

Anti-wear and Extreme Pressure (EP) Additives

Internal combustion engine lubricating oils typically include the presence of anti-wear and/or extreme pressure additives in order to provide adequate anti-wear protection for the engine. Increasingly, specifications for engine oil performance have exhibited a trend for improved anti-wear properties of the oil. Anti-wear and EP additives perform this role by reducing friction and wear of metal parts.

While there are many different types of anti-wear additives, for several decades the principal anti-wear additive for internal combustion engine crankcase oils has been a metal alkylthiophosphate and more particularly a metal dialkyldithiophosphate in which the primary metal constituent is zinc, or zinc dialkyldithiophosphate (ZDDP). ZDDP compounds are generally of the formula Zn[SP(S)(OR1)(OR2)]2 where R1 and R2 are C1–C18 alkyl groups, preferably C2–C12 alkyl groups. These alkyl groups may be straight chain or branched and may be derived from primary and/or secondary alcohols and/or alkylaryl groups such as alkyl phenols. The ZDDP is typically used in amounts of from about 0.4 to 1.4 weight percent of the total lube oil composition, although more or less can often be used advantageously.

However, it has been found that the phosphorus from these additives has a deleterious effect on the catalyst in catalytic converters and also on oxygen sensors in automobiles. One way to minimize this effect is to replace some or all of the ZDDP with phosphorus-free, anti-wear additives.

A variety of non-phosphorus additives have also been used as anti-wear additives. Sulfurized olefins are useful as anti-wear and EP additives. Sulfur-containing olefins can be prepared by sulfurization or various organic materials including aliphatic, arylaliphatic or alicyclic olefinic hydrocarbons containing from about 3 to 30 carbon atoms, preferably about 3 to 20 carbon atoms. The olefinic compounds contain at least one non-aromatic double bond. Such compounds are defined by the formula $$R^3R^4C{=}CR^5R^6$$

where each of $R^3$, $R^4$, $R^5$, $R^6$ are independently hydrogen or a hydrocarbon radical. Preferred hydrocarbon radicals are alkyl or alkenyl radicals. Any two of $R^3$, $R^4$, $R^5$, and $R^6$ may be connected so as to form a cyclic ring. Additional information concerning sulfurized olefins and their preparation can be found in U.S. Pat. No. 4,941,984, incorporated by reference herein in its entirety.

The use of polysulfides of thiophosphorus acids and thiophosphorus acid esters as lubricant additives is disclosed in U.S. Pat. Nos. 2,443,264; 2,471,115; 2,526,497; and 2,591,577, which are fully incorporated by reference. Addition of phosphorothionyl disulfides as anti-wear, antioxidant, and EP additives is disclosed in U.S. Pat. No. 3,770,854, which is fully incorporated by reference. Use of alkylthiocarbamoyl compounds [bis(dibutyl)thiocarbamoyl, for example] in combination with a molybdenum compound (oxymolybdenum diisopropylphosphorodithioate sulfide, for example) and a phosphorus ester (dibutyl hydrogen phosphite, for example) as anti-wear additives in lubricants is disclosed in U.S. Pat. No. 4,501,678, which is fully incorporated by reference. U.S. Pat. No. 4,758,362, which is fully incorporated by reference, discloses use of a carbamate additive to provide improved anti-wear and extreme pressure properties. The use of thiocarbamate as an anti-wear additive is disclosed in U.S. Pat. No. 5,693,598, which is fully incorporated by reference. Thiocarbamate/molybdenum complexes such as moly-sulfur alkyl dithiocarbamate trimer complex (R=C8–C18 alkyl) are also useful anti-wear agents.

Esters of glycerol may be used as anti-wear agents. For example, mono-, di-, and tri-oleates, mono-palmitates and mono-myristates may be used.

ZDDP has been combined with other compositions that provide anti-wear properties. U.S. Pat. No. 5,034,141, which is fully incorporated by reference, discloses that a combination of a thiodixanthogen compound (octylthiodixanthogen, for example) and a metal thiophosphate (ZDDP, for example) can improve anti-wear properties. U.S. Pat. No. 5,034,142, which is fully incorporated by reference, discloses that use of a metal alkyoxyalkylxanthate (nickel ethoxy-ethylxanthate, for example) and a dixanthogen (diethoxyethyl dixanthogen, for example) in combination with ZDDP improves anti-wear properties.

Preferred anti-wear additives include phosphorus and sulfur compounds such as zinc dithiophosphates and/or sulfur, nitrogen, boron, molybdenum phosphorodithioates, molybdenum dithiocarbamates and various organo-molybdenum derivatives including heterocyclics (including dimercaptothia-diazoles, mercaptobenzothiazoles, triazines and the like), alicyclics, amines, alcohols, esters, diols, triols, fatty amides and the like can also be used. Such additives may be used in an amount of about 0.01 to 6 weight percent, preferably about 0.01 to 4 weight percent.

Viscosity Index Improvers

Viscosity index improvers (also known as VI improvers, viscosity modifiers, and viscosity improvers) provide lubricants with high and low temperature operability. These additives impart shear stability at elevated temperatures and acceptable viscosity at low temperatures.

Suitable viscosity index improvers include high molecular weight hydrocarbons, olefin polymers and copolymers, polyesters and viscosity index improver dispersants that function as both a viscosity index improver and a dispersant. Typical molecular weights of these polymers range from about 10,000 to about 1,000,000, more typically about 20,000 to about 500,000, and even more typically between about 50,000 and about 200,000.

Examples of suitable viscosity index improvers are polymers and copolymers of methacrylate, butadiene, olefins, or alkylated styrenes. Polyisobutylene is a commonly used viscosity index improver. Another suitable viscosity index improver is polymethacrylate (copolymers of various chain length alkyl methacrylates, for example), some formulations of which also serve as pour point depressants. Other suitable viscosity index improvers include copolymers of ethylene and propylene, hydrogenated block copolymers of styrene and isoprene, and polyacrylates (copolymers of various chain length acrylates, for example). Specific examples include styrene-isoprene or styrene-butadiene based polymers of about 50,000 to 200,000 molecular weight.

In one embodiment of the present invention, viscosity index improvers are used in an amount of about 0.01 to 6 weight percent, preferably about 0.01 to 4 weight percent.

Antioxidants

Antioxidants retard the oxidative degradation of base stocks during service. Such degradation may result in deposits on metal surfaces, the presence of sludge, or a viscosity increase in the lubricant. A wide variety of oxidation inhibitors that are useful in lubricating oil compositions are well known. See, Klamann in Lubricants and Related Products, op cit., and U.S. Pat. Nos. 4,798,684 and 5,084,197, for example, the disclosures of which are incorporated by reference herein in their entirety.

Useful antioxidants include hindered phenols. These phenolic antioxidants may be ashless (metal-free) phenolic compounds or neutral or basic metal salts of certain phenolic compounds. Typical phenolic antioxidant compounds are the hindered phenolics that contain a sterically hindered hydroxyl group, and these include those derivatives of dihydroxy aryl compounds in which the hydroxyl groups are in the o- or p-position to each other. Typical phenolic antioxidants include the hindered phenols substituted with C6+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; and 2-methyl-6-t-butyl-4-dodecyl phenol. Other useful hindered mono-phenolic antioxidants may include, for example, hindered 2,6-di-alkyl-phenolic propionic ester derivatives. Bis-phenolic antioxidants may also be advantageously used in combination with the instant invention. Examples of ortho coupled phenols include: 2,2'-bis(6-t-butyl-4-heptyl phenol); 2,2'-bis(6-t-butyl-4-octyl phenol); and 2,2'-bis(6-t-butyl-4-dodecyl phenol). Para coupled bis phenols include, for example, 4,4'-bis(2,6-di-t-butyl phenol) and 4,4'-methylene-bis(2,6-di-t-butyl phenol).

Non-phenolic oxidation inhibitors that may be used include aromatic amine antioxidants and these may be used either as such or in combination with phenolics. Typical examples of non-phenolic antioxidants include: alkylated and non-alkylated aromatic amines such as the aromatic monoamines of the formula R8R9R10 N where R8 is an aliphatic, aromatic or substituted aromatic group, R9 is an aromatic or a substituted aromatic group, and R10 is H, alkyl, aryl or R11S(O)XR12 where R11 is an alkylene, alkenylene, or aralkylene group, R12 is a higher alkyl group, or an alkenyl, aryl, or alkaryl group, and x is 0, 1 or 2. The aliphatic group R8 may contain from 1 to about 20 carbon atoms, and preferably contains from 6 to 12 carbon atoms. The aliphatic group is a saturated aliphatic group. Preferably, both R8 and R9 are aromatic or substituted aromatic groups, and the aromatic group may be a fused ring aromatic group such as naphthyl. Aromatic groups R8 and R9 may be joined together with other groups such as S.

Typical aromatic amine antioxidants have alkyl substituent groups of at least about 6 carbon atoms. Examples of aliphatic groups include hexyl, heptyl, octyl, nonyl, and decyl. Generally, the aliphatic groups will not contain more than about 14 carbon atoms. The general types of amine antioxidants useful in the present compositions include diphenylamines, phenyl naphthylamines, phenothiazines, imidodibenzyls and diphenyl phenylene diamines. Mixtures of two or more aromatic amines are also useful. Polymeric amine antioxidants can also be used. Particular examples of aromatic amine antioxidants useful in the present invention include: p,p'-dioctyldiphenylamine; t-octylphenyl-alpha-naphthylamine; phenyl-alphanaphthylamine; and p-octylphenyl-alpha-naphthylamine.

Sulfurized alkyl phenols and alkali or alkaline earth metal salts thereof also are useful antioxidants. Low sulfur peroxide decomposers are useful as antioxidants.

Another class of antioxidant used in lubricating oil compositions is oil-soluble copper compounds. Any oil-soluble suitable copper compound may be blended into the lubricating oil. Examples of suitable copper antioxidants include copper dihydrocarbyl thio or dithio-phosphates and copper salts of carboxylic acid (naturally occurring or synthetic). Other suitable copper salts include copper dithiacarbamates, sulphonates, phenates, and acetylacetonates. Basic, neutral, or acidic copper Cu(I) and or Cu(II) salts derived from alkenyl succinic acids or anhydrides are known to be particularly useful.

Preferred antioxidants include hindered phenols, arylamines, low sulfur peroxide decomposers and other related components. These antioxidants may be used individually by type or in combination with one another. Such additives may be used in an amount of about 0.01 to 5 weight percent, preferably about 0.01 to 1.5 weight percent.

Dispersants

During engine operation, oil insoluble oxidation byproducts are produced. Dispersants help keep these byproducts in solution, thus diminishing their deposit on metal surfaces. Dispersants may be ashless or ash-forming in nature. Preferably, the dispersant is ashless. So-called ashless dispersants are organic materials that form substantially no ash upon combustion. For example, non-metal-containing or borated metal-free dispersants are considered ashless. In contrast, metal-containing detergents discussed above form ash upon combustion.

Suitable dispersants typically contain a polar group attached to a relatively high molecular weight hydrocarbon chain. The polar group typically contains at least one element of nitrogen, oxygen, or phosphorus. Typical hydrocarbon chains contain about 50 to 400 carbon atoms.

Chemically, many dispersants may be characterized as phenates, sulfonates, sulfurized phenates, salicylates, naphthenates, stearates, carbamates, thiocarbamates, and phosphorus derivatives. A particularly useful class of dispersants is the alkenylsuccinic derivatives, typically produced by the reaction of a long chain substituted alkenyl succinic compound, usually a substituted succinic anhydride, with a polyhydroxy or polyamino compound. The long chain group constituting the oleophilic portion of the molecule, which confers solubility in the oil, is normally a polyisobutylene group. Many examples of this type of dispersant are well known commercially and in the literature. Exemplary U.S. patents describing such dispersants are U.S. Pat. Nos. 3,172,892; 3,2145,707; 3,219,666; 3,316,177; 3,341,542; 3,444,170; 3,454,607; 3,541,012; 3,630,904; 3,632,511; 3,787,374; and 4,234,435. Other types of dispersants are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726, 882; 4,454,059; 3,329,658; 3,449,250; 3,519,565; 3,666,730; 3,687,849; 3,702,300; 4,100,082; and 5,705,458, which are fully incorporated by reference. A further description of dispersants may be found, for example, in European Patent Application 471071, which is incorporated by reference.

Hydrocarbyl-substituted succinic acid compounds are popular dispersants. In particular, succinimide, succinate esters, or succinate ester amides prepared by the reaction of a hydrocarbon-substituted succinic acid compound preferably having at least 50 carbon atoms in the hydrocarbon substituent, with at least one equivalent of an alkylene amine are particularly useful.

Succinimides are formed by the condensation reaction between alkenyl succinic anhydrides and amines. Molar ratios can vary depending on the polyamine. For example, the molar ratio of alkenyl succinic anhydride to TEPA can vary from about 1:1 to about 5:1. Representative examples are shown in U.S. Pat. Nos. 3,087,936; 3,172,892; 3,219,666; 3,272,746; 3,322,670; 3,652,616; 3,948,800; and Canada Patent 1,094,044, which are incorporated herein in their entirety by reference.

Succinate esters are formed by the condensation reaction between alkenyl succinic anhydrides and alcohols or polyols. Molar ratios can vary depending on the alcohol or polyol used. For example, the condensation product of an alkenyl succinic anhydride and pentaerythritol is a useful dispersant.

Succinate ester amides are formed by condensation reaction between alkenyl succinic anhydrides and alkanol amines. For example, suitable alkanol amines include ethoxylated polyalkylpolyamines, propoxylated polyalkylpoly-amines and polyalkenylpolyamines such as polyethylene polyamines. One example is propoxylated hexamethylenediamine. Representative examples are shown in U.S. Pat. No. 4,426,305, incorporated herein by reference.

The molecular weight of the alkenyl succinic anhydrides used in the preceding paragraphs will range between about 800 and 2,500 or more. The hydrocarbyl groups may be, for example, a group such as polyisobutylene having a molecular weight of about 500 to 5,000 or a mixture of such groups. The above products can be post-reacted with various reagents such as sulfur, oxygen, formaldehyde, carboxylic acids such as oleic acid, hydrocarbyl dibasic acids or anhydrides, and boron compounds such as borate esters or highly borated dispersants. In one embodiment according to the present invention, the dispersants are borated with from about 0.1 to about 5 moles of boron per mole of dispersant reaction product, including those derived from mono-succinimide, bis-succinimide (also known as disuccinimides), and mixtures thereof.

Mannich base dispersants are made from the reaction of alkylphenols, formaldehyde, and amines. See U.S. Pat. No. 4,767,551, which is incorporated herein by reference. Process acids and catalysts, such as oleic acid and sulfonic acids, can also be part of the reaction mixture. Molecular weights of the alkylphenols range from 800 to 2,500. Representative examples are shown in U.S. Pat. Nos. 3,697,574; 3,703,536; 3,704,308; 3,751,365; 3,756,953; 3,798,165; and 3,803,039, which are incorporated herein in their entirety by reference.

Typical high molecular weight aliphatic acid modified Mannich condensation products useful in this invention can be prepared from high molecular weight alkyl-substituted hydroxyaromatics or HN(R)2 group-containing reactants.

Examples of high molecular weight alkyl-substituted hydroxyaromatic compounds are polypropylphenol, polybutylphenol, and other polyalkylphenols. These polyalkylphenols can be obtained by the alkylation, in the presence of an alkylating catalyst, such as BF3, of phenol with high molecular weight polypropylene, polybutylene, and other polyalkylene compounds to give alkyl substituents on the benzene ring of phenol having an average of from about 600 to about 100,000 molecular weight.

Examples of HN(R)2 group-containing reactants are alkylene polyamines, principally polyethylene polyamines. Other representative organic compounds containing at least one HN(R)2 group suitable for use in the preparation of Mannich condensation products are well known and include the mono- and di-amino alkanes and their substituted analogs, e.g., ethylamine and diethanol amine; aromatic diamines, e.g., phenylene diamine, diamino naphthalenes; heterocyclic amines, e.g., morpholine, pyrrole, pyrrolidine, imidazole, imidazolidine, and piperidine; melamine and their substituted analogs.

Examples of alkylene polyamide reactants include ethylenediamine, diethylene triamine, triethylene tetraamine, tetraethylene pentaamine, pentaethylene hexamine, hexaethylene heptaamine, heptaethylene octaamine, octaethylene nonaamine, nonaethylene decamine, and decaethylene undecamine and mixture of such amines having nitrogen contents corresponding to the alkylene polyamines, in the formula H2N—(Z—NH—)nH, mentioned before, Z is a divalent ethylene and n is 1 to 10 of the foregoing formula. Corresponding propylene polyamines such as propylene diamine and di-, tri-, tetra-, penta-propylene tri-, tetra-, penta- and hexaamines are also suitable reactants. The alkylene polyamines are usually obtained by the reaction of ammonia and dihalo alkanes, such as dichloro alkanes. Thus the alkylene polyamines obtained from the reaction of 2 to 11 moles of ammonia with 1 to 10 moles of dichloro alkanes having 2 to 6 carbon atoms and the chlorines on different carbons are suitable alkylene polyamine reactants.

Aldehyde reactants useful in the preparation of the high molecular products useful in this invention include the aliphatic aldehydes such as formaldehyde (such as paraformaldehyde and formalin), acetaldehyde and aldol (b-hydroxybutyraldehyde, for example). Formaldehyde or a formaldehyde-yielding reactant is preferred.

Hydrocarbyl substituted amine ashless dispersant additives are well known to one skilled in the art; see, for example, U.S. Pat. Nos. 3,275,554; 3,438,757; 3,565,804; 3,755,433; 3,822,209; and 5,084,197, which are incorporated herein in their entirety by reference.

Preferred dispersants include borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a number average molecular weight (Mn) of from about 500 to about 5,000 or a mixture of such hydrocarbylene groups. Other preferred dispersants include succinic acid-esters and amides, alkylphenol-polyamine coupled Mannich adducts, their capped derivatives, and other related components. In one embodiment, such additives are used in an amount of about 0.1 to 20 weight percent, preferably about 0.1 to 8 weight percent.

Pour Point Depressants

Conventional pour point depressants (also known as lube oil flow improvers) may be added to the compositions of the present invention if desired. The pour point depressant may be added to lubricating compositions of the present invention to lower the minimum temperature at which the fluid will flow or can be poured. Examples of suitable pour point depressants include polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. U.S. Pat. Nos. 1,815,022; 2,015,748; 2,191,498; 2,387,501; 2,655,479; 2,666,746; 2,721,877; 2,721,878; and 3,250,715, which are fully incorporated by reference, describe useful pour point depressants and/or the preparation thereof. In one embodiment of the present invention, such additives are used in an amount of about 0.01 to 5 weight percent, preferably about 0.01 to 1.5 weight percent.

Corrosion Inhibitors

Corrosion inhibitors are used to reduce the degradation of metallic parts that are in contact with the lubricating oil composition. Suitable corrosion inhibitors include thiadiazoles and triazoles. See, for example, U.S. Pat. Nos. 2,719,125; 2,719,126; and 3,087,932, which are incorporated herein by reference in their entirety. In one embodiment of the present invention, such additives are used in an amount of about 0.01 to 5 weight percent, preferably about 0.01 to 1.5 weight percent.

Seal Compatibility Additives

Seal compatibility agents help to swell elastomeric seals by causing a chemical reaction in the fluid or a physical change in the elastomer. Suitable seal compatibility agents for lubricating oils include organic phosphates, aromatic esters, aromatic hydrocarbons, esters (butylbenzyl phthalate, for example), and polybutenyl succinic anhydride. Additives of this type are commercially available. In one embodiment of the present invention, such additives are used in an amount of about 0.01 to 3 weight percent, preferably about 0.01 to 2 weight percent.

Anti-Foam Agents

Anti-foam agents may advantageously be added to lubricant compositions. These agents retard the formation of stable foams. Silicones and organic polymers are typical anti-foam agents. For example, polysiloxanes, such as silicon oil or polydimethyl siloxane, provide anti-foam properties. Anti-foam agents are commercially available and may be used in conventional minor amounts along with other additives such as demulsifiers. Usually the amount of these additives combined is less than 1 percent and often less than 0.1 percent.

Inhibitors and Anti-Rust Additives

Anti-rust additives (or corrosion inhibitors) are additives that protect lubricated metal surfaces against chemical attack by water or other contaminants. A wide variety of these are commercially available; they are referred to also in Klamann in Lubricants and Related Products, op cit.

One type of anti-rust additive is a polar compound that wets the metal surface preferentially, protecting it with a film of oil. Another type of anti-rust additive absorbs water by incorporating it in a water-in-oil emulsion so that only the oil touches the metal surface. Yet another type of anti-rust additive chemically adheres to the metal to produce a non-reactive surface. Examples of suitable additives include zinc dithiophosphates, metal phenolates, basic metal sulfonates, fatty acids and amines. In one embodiment of the present invention, such additives are used in an amount of about 0.01 to 5 weight percent, preferably about 0.01 to 1.5 weight percent.

Typical Additive Amounts

When lubricating oil compositions contain one or more of the additives discussed above, the additive(s) are blended into the composition in an amount sufficient for it to perform its intended function. Typical amounts of such additives useful in the present invention are shown in Table 1 below.

Note that many of the additives are shipped from the manufacturer and used with a certain amount of processing oil solvent in the formulation. Accordingly, the weight amounts in Table 1, as well as other amounts mentioned in this patent, are directed to the amount of active ingredient (that is the non-solvent portion of the ingredient). The weight percents indicated below are based on the total weight of the lubricating oil composition.

TABLE 1

Typical Amounts of Various Lubricant Components

| Compound | Approximate Weight Percent (Useful) | Approximate Weight Percent (Preferred) |
|---|---|---|
| Detergent | 0.01–6 | 0.01–4 |
| Dispersant | 0.1–20 | 0.1–8 |
| Friction Reducer | 0.01–5 | 0.01–1.5 |
| Viscosity Index Improver | 0.01–40 | 0.01–30, preferably 0.01–15 |
| Antioxidant | 0.01–5 | 0.01–2.0 |
| Corrosion Inhibitor | 0.01–5 | 0.01–1.5 |
| Anti-wear Additive | 0.01–6 | 0.01–4 |
| Pour Point Depressant | 0.01–5 | 0.01–1.5 |
| Anti-foam Agent | 0.001–3 | 0.001–0.20 |
| Base stock | Balance | Balance |

EXPERIMENTAL SECTION

Example 1

A 1-decene and 1-dodecene mixture containing 70 weight percent 1-decene and 30 weight percent 1-dodecene was oligomerized in two continuous stirred-tank reactors in series at 18° C. and 5 psig (34,474 Pa) using BF3 promoted with a 12:1 mole ratio mixture of ethanol and ethyl acetate at a total catalyst concentration of 3.5 weight percent. When a steady-state condition was attained, a sample was distilled to remove the monomers and dimers. The bottoms stream was hydrogenated to saturate the trimers/oligomers. The hydrogenated product includes 5 cSt PAO. A sample of this hydrogenated product was distilled and distillation cuts blended to produce different viscosities of PAO. The 4 cSt PAO contained mostly trimers and tetramers while the 6 cSt PaO contained mostly trimers, tetramers, and pentamers. The properties of the final 4 cSt, 5 cSt and 6 cSt PAO products, as well as those of the 1-decene and 1-dodecene based references, are shown in Tables 2, 3, and 4 below. The Noack volatility of each product is significantly lower than that of the C10 based reference oil. However, the pour points are higher than those of the corresponding C10-based reference oils but are well within desired specifications. Both the 1-dodecene based 5 cSt and 6 cSt PAOs have pour points that do not meet desired specifications.

Example 2

Similar to Example 1, except that the olefin mixture contained 60 weight percent 1-decene and 40 weight percent 1-dodecene was oligomerized using BF3 promoted with a 3.5:1 mole ratio mixture of butanol and n-butyl acetate, at a total catalyst concentration of 5.3 weight percent. With the incorporation of more 1-dodecene in the feed mixture, the Noack volatility of each product was further reduced. The pour points are either the same or higher than those of the products made from 70/30 1-decene/1-dodecene mix.

Example 3

Similar to Example 1, except that the olefin mixture contained 50 weight percent 1-decene and 50 weight percent 1-dodecene was oligomerized using BF3 promoted with a 4:1 mole ratio mixture of n-butanol and n-butyl acetate, at a total catalyst concentration of 1.8 weight percent. Again, the Noack volatility of each product decreased with the increase of 1-dodecene content of the feed mixture.

TABLE 2

Properties of 4 cSt PAO

| Example No. | Feed $C_{10}$:$C_{12}$ | 100° C. Vis. cSt | −40° C. Vis cSt | VI | Noack Vol. wt % | Pour Point ° C. |
|---|---|---|---|---|---|---|
| Reference A | 100:0 | 4.10 | 2850 | 122 | 13.5 | <−60 |
| 1 | 70:30 | 4.10 | 2899 | 128 | 11.7 | −60 |
| 2 | 60:40 | 4.09 | 2680 | 130 | 10.6 | −60 |
| 3 | 50:50 | 4.15 | 2930 | 134 | 9.9 | — |

TABLE 3

Properties of 5 cSt PAG

| Example No. | Feed $C_{10}$:$C_{12}$ | 100° C. Vis. cSt | −40° C. Vis cSt | VI | Noack Vol. wt % | Pour Point ° C. |
|---|---|---|---|---|---|---|
| Reference B | 100:0 | 5.05 | 4911 | 135 | 8.9 | <−56 |
| 1 | 70:30 | 5.10 | 5272 | 136 | 7.7 | −56 |
| 2 | 60:40 | 5.00 | 4520 | 139 | 7.5 | −54 |
| 3 | 50:50 | 5.00 | 4346 | 140 | 6.4 | — |
| Reference C | 0:100 | 5.25 | 4647 | 148 | 4.8 | −45 |

TABLE 4

Properties of 6 cSt PAO

| Example No. | Feed $C_{10}$:$C_{12}$ | 100° C. Vis. cSt | −40° C. Vis cSt | VI | Noack Vol. wt % | Pour Point ° C. |
|---|---|---|---|---|---|---|
| Reference D | 100:0 | 5.9 | 7906 | 138 | 6.8 | −59 |
| 1 | 70:30 | 5.89 | 7817 | 140 | 5.3 | −56 |
| 2 | 60:40 | 5.90 | 7400 | 140 | 5.0 | −54 |
| 3 | 50:50 | 5.86 | 6607 | 143 | 4.3 | — |
| Reference E | 0:100 | 6.20 | 8150 | 146 | 4.0 | −42 |

Formulated Lubricant 1

A lubricant was formulated using a 5 cSt PAO comprising about 50 wt % decene and about 50 wt % dodecene. The 5 cSt PAO was prepared as described in Example 3 above. About 36 wt % of 5 cSt PAO was blended with about 35 wt % of 4 cSt PAO, prepared conventionally from decene, and about 9.3 wt % alkylated naphthalene, which served as a co-base stock. The formulation included 19.8 wt % of an additive package that included a detergent, a dispersant and an inhibitor. The weight percentages are based on the fully formulated engine oil. The lubricant was subjected to the Volkswagen T-4 Engine test. The test results are shown in Table 5.

Comparative Formulated Lubricant 2

A lubricant was formulated using a 4 cSt PAO prepared from decene by conventional BF3 polymerization. About 46 wt % of 4 cSt PAO was blended with about 25 wt % of 6 cSt PAO, prepared conventionally from decene, and about 9.1 wt % alkylated naphthalene, which served as a co-base stock. The formulation included 19.8 wt % of an additive package that included a detergent, a dispersant and an inhibitor. The weight percentages are based on the fully formulated engine oil. The lubricant was subjected to the Volkswagen T-4 Engine test. The test results are shown in Table 5.

TABLE 5

Volkswagen T-4 Engine Test Results

| | Descriptions | Lubricant 1 | Comparative Lubricant 2 |
|---|---|---|---|
| | Detergent/Dispersant/Inhibitor Performance Package | 19.8 | 19.8 |
| | Base Stocks | | |
| | Alkylated Naphthalene | 9.3 | 9.1 |
| | PAO 6 | | 25 |
| | PAO 4 | 35 | 46 |
| | PAO 5 | 36 | |
| | Total | 100 | 100 |
| Blend Properties ASTM Methods | | | |
| D445 KV at 40° C., cSt | Kinematic Viscosity at 40° C. | 80.44 | 79.92 |
| D445 KV at 100° C., cSt | Kinematic Viscosity at 100° C. | 14.2 | 14.0 |
| D5293 CCS −35, cP | CCS @ −35° C., cP | 5740 | 6000 |
| D5950 | Pour Point, ° C. | −57 | −57 |
| D97 | Pour Point, ° C. | <−54 | |
| D5985 | Pour Point, ° C. | <−54 | <−54 |
| D5949 | Pour Point, ° C. | <−59 | −58 |
| | VW T4 Data | | |
| | Viscosity increase, % | 84.7 | 162.4 |
| | End of Tests viscosity, cSt | 147.8 | 208.8 |
| | Overall Test Result | PASS | FAIL |

The test data show that use of Lubricant 1, one embodiment according to the present invention, resulted in a lower viscosity increase during the VW T-4 test and a lower end of test viscosity when evaluated against Comparative Lubricant 2.

While the invention has been described and illustrated with reference to certain preferred embodiments thereof, those skilled in the art will appreciate that various changes, modifications and substitutions can be made therein without departing from the spirit and scope of the invention.

We claim:

1. A formulated lubricant comprising a base stock, the base stock comprising:

(a) a 5 cSt PAO comprising from about 40 to about 80 weight percent of 1-decene and from about 60 to about 20 weight percent of 1-dodecene based on the weight of the 5 cSt PAO; and (b) a 4 cSt PAO.

2. The lubricant according to claim 1, wherein the 5 cSt PAO comprises about 50 weight percent of 1-decene and about 50 weight percent 1-dodecene.

3. The lubricant according to claim 1, wherein the 5 cSt PAO has a Noack volatility of about 4 to about 12 weight percent loss.

4. The lubricant according to claim 1, wherein the 5 cSt PAO has a pour point of about −40° C. to about −65° C.

5. The lubricant according to claim 1, further comprising a mineral oil or a synthetic oil.

6. The lubricant according to claim 1, further comprising at least one of a detergent, an anti-wear additive, an extreme pressure additive, a viscosity index improver, an anti-oxidant, a dispersant, a pour point depressant, a corrosion inhibitor, a seal compatibility additive, a friction reducer, and an anti-foam agent.

7. The lubricant of claim 1, wherein the 5 cSt PAO comprises 50 to 75 weight percent of 1-decene and 50 to 25 weight percent 1-dodecene.

8. The lubricant of claim 1, wherein the 4 cSt fraction has a Noack volatility of 9 to 16% weight loss.

9. The lubricant of claim 1, wherein the 4 cSt fraction has a pour point of from about −45° C. to about −65° C.

10. A formulated lubricant comprising a base stock, the base stock comprising:

(a) a 5 cSt PAO comprising from about 40 to about 80 weight percent of 1-decene and from about 60 to about 20 weight percent of 1-dodecene; and (b) a 4 cSt PAO, wherein the 4 cSt PAO is prepared by a process comprising:

(1) oligomerizing an α-olefin feed comprising from about 40 to about 80 weight percent of 1-decene and from about 60 to 20 weight percent of 1-dodecene, in the presence of $BF_3$ and at least two different co-catalysts, wherein the co-catalysts are selected from a group (i) alcohols and group (ii) alkyl acetates:

provided that at least one co-catalyst is from the group (i) alcohols and at least one co-catalyst is from the group (ii) alkyl acetates; and (2) hydrogenation of at least a portion of residual unsaturation.

11. The lubricant of claim 10, wherein the group (i) alcohols is selected from $C_1$–$C_{10}$ alcohols and the group (ii) alkyl acetates is selected from $C_1$–$C_{10}$ alkyl acetates.

12. The lubricant of claim 11, wherein the group (i) alcohols are selected from $C_1$–$C_{10}$ alcohols and the group (ii) alkyl acetates are selected from $C_1$–$C_6$ alkyl acetates.

13. The lubricant of claim 11, wherein the $C_1$–$C_{10}$ alcohols are selected from ethanol, n-propanol, n-butanol, n-pentanol, and n-hexanol.

14. The lubricant of claim 10, wherein the group (i) alcohol and group (ii) alkyl acetate co-catalysts comprise ethanol and ethyl acetate, respectively.

15. The lubricant of claim 10, wherein the group (i) alcohol and group (ii) alkyl acetate co-catalysts comprise n-butanol and n-butyl acetate, respectively.

16. A formulated lubricant comprising:

(a) a 5 cSt PAO comprising from about 40 to about 80 weight percent of 1-decene and from about 60 to about 20 weight percent of 1-dodecene; and (b) a second PAO having a viscosity lower than about 5 cSt.

17. A process for preparing a formulated lubricant comprising the steps of blending (a) a 5 cSt PAO comprising from about 40 to about 80 weight percent of 1-decene and about 60 to about 20 weight percent of 1-dodecene; and (b) a 4 cSt PAO to form a mixed PAO composition.

18. The process according to claim 17, wherein the 5 cSt PAO comprises about 50 weight percent of 1-decene and about 50 weight percent 1-dodecene.

19. The process according to claim 17, wherein the 5 cSt PAO has a Noack volatility of from about 4 to about 12 weight percent loss.

20. The process according to claim 17, further comprising blending a mineral oil or a synthetic oil with the mixed PAO composition.

21. The process according to claim 17, further comprising blending at least one of a detergent, an anti-wear additive, an extreme pressure additive, a viscosity index improver, an anti-oxidant, a dispersant, a pour point depressant, a corrosion inhibitor, a seal compatibility additive, a friction reducer, and an anti-foam agent with the mixed PAO composition.

22. The process according to claim 17, wherein the 5 cSt PAO is prepared by a process comprising:

(a) oligomerizing an α-olefin feed comprising from about 40 to about 80 weight percent of 1-decene and from about 60 to about 20 weight percent of 1-dodecene, in the presence of BF3 and at least two different co-catalysts, wherein co-catalysts are selected from group (i) alcohols and group (ii) alkyl acetates:

provided that at least one of the co-catalyst is from the group (i) alcohols and at least one of the co-catalyst is from the group (ii)alkyl acetates; and (b) hydrogenation of at least a portion of residual unsaturation.

23. A formulated lubricant comprising (a) a base stock;

(b) at least one 5 cSt PAO lubricant comprising a hydrogenated oligomerized α-olefin; and (c) a 4 cSt PAO;

wherein the oligomerized α-olefin is prepared from an olefin feed comprising from about 40 to about 80 weight percent of 1-decene and from about 60 to about 20 weight percent 1-dodecene, wherein the oligomerized α-olefin has a Noack volatility of from about 4 to about 12% weight loss and a pour point of from about −40° C. to about −65° C.

24. The lubricant of claim 11, wherein an oligomerized, hydrogenated PAO is distilled to provide the 5 cSt PAO and at least one of the 4 cSt PAO and a 6 cSt PAO.

25. The process of claim 23, wherein the 4 cSt fraction has a Noack volatility of from about 9 to about 16% weight loss.

26. The process of claim 23, wherein the 4 cSt fraction has a pour point of from about −45° C. to about −65° C.

27. The process of claim 23, wherein the 6 cSt fraction has a pour point of from about −40° C. to about −60° C.

28. The process of claim 23, wherein the co-catalyst is used in an amount of from about 10 weight percent, based on the weight of the α-olefin feed, and wherein the ratio of the group (i) co-catalyst to group (ii) cocatalyst ranges from about 0.2 to 15.

29. A process for preparing a base stock, comprising (1) oligomerizing an α-olefin feed, wherein the feed consists esentially of from about 40 to about 80 weight percent of 1-decene and from about 60 to about 20 weight percent 1-dodecene, in the presence of BF3 and at least two different cocatalysts, wherein the co-catalysts are selected from group (i) alcohols and group (ii) alkyl acetates:

provided that at least one of the co-catalysts is from the group (i) alcohols and at least one of the co-catalysts is from the group (ii) alkyl acetates; and (2) hydrogenation of at least a portion of residual unsaturation.

30. The process of claim 29, further comprising hydrogenation of at least 90 percent of residual unsaturation.

31. The process of claim 29, wherein the group (i) alcohols are selected from $C_1$–$C_{10}$ alcohols and the group (ii) alkyl acetates are selected from $C_1$–$C_{10}$ alkyl acetates.

32. The process of claim 31, wherein the group (i) alcohols are selected from $C_1$–$C_6$ alcohols and the group (ii) alkyl acetates are selected from $C_1$–$C_6$ alkyl acetates.

33. The process of claim 32, wherein the $C_1$–$C_6$ alcohols are selected from ethanol, n-propanol, n-butanol, n-pentanol and n-hexanol.

34. The process of claim 29, wherein the group (i) alcohols and group (ii) co-catalysts comprise ethanol and ethyl acetate, respectively.

35. The process of claim 29, wherein the group (i) alcohols and group (ii) alkyl acetates co-catalysts comprise n-butanol and butyl acetate, respectively.

36. The process of claim 29, wherein the base stock has a Noack volatility of from about 6 to about 10% weight loss and a pour point of from about −50° C. to about −58° C.

37. The process of claim 29, wherein the feed consists essentially of from about 45 to about 75 weight percent of 1-decene and from about 55 to about 25 weight percent 1-dodecene.

38. A base stock comprising an oligomerized α-olefin which has been subjected to hydrogenation, wherein the oligomerized α-olefin is prepared by the process of oligomerizing an olefin feed comprising about 40 to about 80 weight percent of 1-decene and from about 60 to about 20 weight percent 1-dodecene, wherein the oligomerized α-olefin has a Noack volatility of from about 4 to about 12% weight loss and a pour point of from about −40° C. to about −65° C.

39. The base stock of claim 38, wherein the Noack volatility ranges from about 5.0 to about 11% weight loss.

40. The base stock of claim 38, wherein the pour point ranges from about −45° C. to about −65° C.

41. The base stock of claim 38, wherein said base stock has a viscosity of about 5 cSt at 100° C.

42. The base stock of claim 38, wherein said base stock has a viscosity of about 4 cSt at 100° C.

43. The base stock of claim 38, wherein said base stock has a viscosity of about 6 cSt at 100° C.

44. The base stock of claim 38, wherein the feed consists essentially of about 45 to about 75 weight percent of 1-decene and about 55 to about 25 weight percent 1-dodecene.

45. The base stock of claim 39, wherein said base stock is prepared by the oligomerization of the olefin feed in the presence of $BF_3$ and at least two different co-catalysts selected from group (i) alcohols and group (ii) alkyl acetates:

provided that at least one of the co-catalysts is from the group (i).

46. The base stock of claim 38, wherein at least 90 percent of residual unsaturation is hydrogenated.

47. The base stock of claim 45, wherein the group (i) alcohols and group (ii) alkyl acetates are selected from $C_1$–$C_{10}$ alcohols and $C_1$–$C_{10}$ alkyl acetates, respectively.

48. The base stock of claim 45, wherein the group (i) alcohols and group (ii) alkyl acetates are selected from $C_1$–$C_6$ alcohols and $C_1$–$C_6$ alkyl acetates, respectively.

49. The base stock of claim 48, wherein the $C_1$–$C_6$ alcohols are selected from ethanol, n-propanol, n-butanol, n-pentanol and n-hexanol.

50. The base stock of claim 45, wherein the group (i) and group (ii) co-catalysts comprise ethanol and ethyl acetate.

51. The base stock of claim 45, wherein the group (i) and group (ii) co-catalysts comprise n-butanol and butyl acetate.

52. A base stock composition comprising:

(1) a conventional base stock; and (2) at least one base stock comprising an oligomerized α-olefin which has been subjected to hydrogenation, wherein the oligomerized α-olefin is prepared from an olefin feed comprising from about 40 to about 80 weight percent of 1-decene and from about 60 to about 20 weight percent of 1-dodecene, wherein the oligomerized α-olefin exhibits a Noack volatility of about 4 to about 12% weight loss and a pour point of about −40° C. to about −65° C.

* * * * *